United States Patent [19]

Undin et al.

[11] Patent Number: 4,637,242

[45] Date of Patent: Jan. 20, 1987

[54] LOCATOR DEVICE FOR A TOOL PROVIDED WITH CRIMPING DIES FOR CABLE SHOES

[75] Inventors: Hans Undin, Åkersberga; Hans Wiener, Täby, both of Sweden

[73] Assignee: C. A. Weidmüller GmbH & Co., Detmold, Fed. Rep. of Germany

[21] Appl. No.: 599,246

[22] Filed: Apr. 11, 1984

[30] Foreign Application Priority Data

Apr. 19, 1983 [SE] Sweden ..... 8302185

[51] Int. Cl.[4] ..... B21D 7/06

[52] U.S. Cl. ..... 72/410; 72/461; 81/421; 29/751

[58] Field of Search ..... 72/410, 409, 461; 29/751, 282; 81/418, 420, 421, 424

[56] References Cited

U.S. PATENT DOCUMENTS

| | | | |
|---|---|---|---|
| 2,086,400 | 7/1937 | Brenizer | 72/410 |
| 2,359,083 | 9/1944 | Carlson | 72/465 |
| 2,812,676 | 11/1957 | Brown | 72/410 |
| 3,523,351 | 8/1970 | Filia | 29/282 |
| 3,673,848 | 7/1972 | Filia | 72/410 |
| 3,710,611 | 1/1973 | Filia | 72/410 |
| 3,931,671 | 1/1976 | Dittmann | 72/461 |

FOREIGN PATENT DOCUMENTS

| | | | |
|---|---|---|---|
| 618161 | 8/1978 | U.S.S.R. | 72/461 |

*Primary Examiner*—Daniel C. Crane

*Attorney, Agent, or Firm*—Toren, McGeady and Goldberg

[57] ABSTRACT

A locator device for a tool with crimping dies for cable shoes has at least one track for accommodating the contact portion of the cable shoe, a stationary stop at the end of the track and a movable stop at a selected location along the track. For treating cable shoes with longer contact portions, the movable stop is lifted from the track so that the stationary stop is operative, and when treating cable shoes with shorter contact portions the movable stop is put in place. The device is preferably made as a readily mountable accessory to the crimping tool.

8 Claims, 6 Drawing Figures

LOCATOR DEVICE FOR A TOOL PROVIDED WITH CRIMPING DIES FOR CABLE SHOES

BACKGROUND OF THE INVENTION

The invention refers to a locator device which preferably defines a readily attachable accessory part to a tool for crimping cable shoes on the ends of electrical conductors.

As is well known, cable shoes have an affixing or crimping portion by which they are crimped on the end of a cable, and a contact portion which is a means of electrical connection of the respective cable with another electrical component.

Cable shoes may be crimped onto conductors in a tool or apparatus which is provided with a pair of reciprocating jaws in which one or more pairs of conveniently shaped crimping dies are provided. More than one pair of dies is provided when cable shoes with different crimping portions shall be treated in the same tool. The tool or apparatus may be embodied by a pair of tongs or by a stationary apparatus.

In order to establish a good electrical as well as mechanical connection between the conductor and the cable shoe it is essential that during the crimping operation the affixing portion is exactly located in the pair of dies, and that the contact portion at the same time in no way is affected by the crimping dies.

It has already been proposed to provide stop means in cable shoe tools defining the position of a cable shoe inserted into the tool. It is an object of the present invention to provide a locator device able to serve cable shoes having contact portions with at least two different lengths and, in a preferred embodiment, also two different widths, and where resetting from one length to another can be accomplished by operating an actuating means.

SUMMARY OF THE INVENTION

A locator device for a crimping tool for cable shoes having a contact portion of varying length for electrical connection and an attachment portion for affixing to an electrical conductor is provided with at least one elongated track for the longest contact portion of the cable shoes to be treated in the tool. A stationary first stop means is provided at the remote end of the track and a movable stop carrier bears a second stop means which according to the position of the carrier either clears the track so that an inserted contact portion strikes the first stop means, or bars the track so that an inserted shorter contact portion strikes the second stop means. In both cases is the position of the crimping section in the crimping tool exactly defined. The bottom portion of the track may be profiled for centrically receiving contact portions with varying widths.

SHORT DESCRIPTION OF THE DRAWINGS

FIGS. 1*a* and 1*b* show in a perspective view two cable shoes belonging to the state of art, FIG. 2 is a side view of a pair of crimping tongs for cable shoes with an affixed locator device according to the present invention in a first embodiment, FIG. 3 shows the front part of the pair of tongs of FIG. 2 in plan view, FIG. 4 is a longitudinal section along the plane IV—IV in FIG. 3 on a greater scale, the stop carrier being for clarity shown detached, FIG. 5 is a cross-section along the plane V—V in FIG. 4, Components having the same function are denoted with identical or analogical references in all drawing figures.

DETAILED DESCRIPTION OF THE INVENTION

Figure 1A:
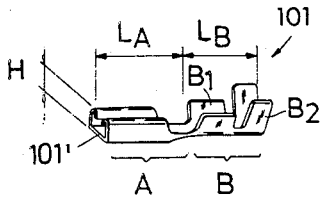
Figure 1B:
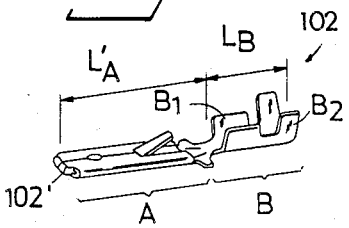

According to FIGS. 1*a* and 1*b*, a cable shoe 101 or 102 has a contact portion A with a length $L_A$ or $L'_A$ respectively and which is shaped to fit with an associated contact means, not shown, and an affixing or crimping portion B having a length $L_B$, which length is irrelevant in the present context. Each contact portion $L_A$ and $L'_A$ is at the free end terminated by a front edge 101' and 102', respectively, which also defines the front edge of the whole terminal. The crimping portion B comprises in both cable shoes shown a first section $B_1$ to be crimped on the stripped end portion of the core of the respective conductor, and a second section $B_2$ to be crimped on the end portion of the insulation of the conductor. Cable shoes of this kind are known and it will be readily understood that both parts $B_1$ and $B_2$ must be located exactly in the intended position in the pair of dies in order to obtain a fully satisfactory crimp connection.

Figure 3:
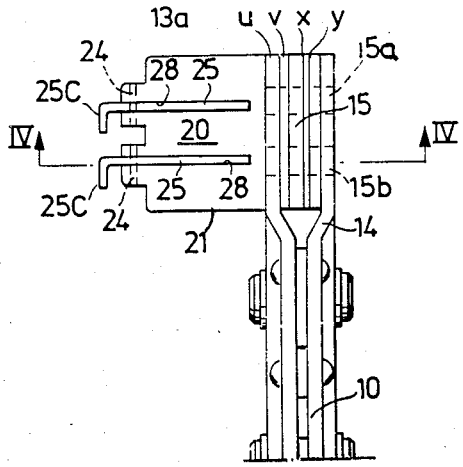
Figure 2:
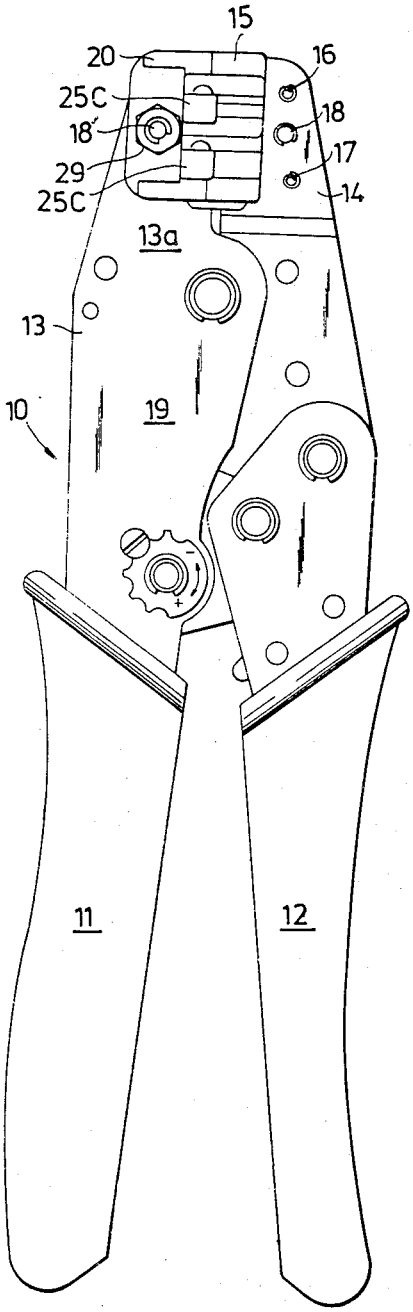

According to FIGS. 2 to 5, a tool or apparatus defined by a pair of cable shoe tongs 10 is provided with a pair of jaws 13, 14 operable by a pair of handles 11, 12. In the jaws 13, 14 are by means of pins 16, 17 and a screw 18 mounted two pairs of co-operating crimping dies, of which only the dies (half pairs) 15*a*, 15*b* arranged in a die carrier 15, mounted in the jaw 4, are shown in FIG. 3. When the jaws 13, 14 are closed one upon another, the sections $B_1$ and $B_2$ of the crimping portion B of a cable shoe 101 or 102 are crimped onto a conductor inserted into the cable shoe.

The crimping die carrier 15 comprises a plurality of assembled plates u, v, x, y of different thickness, some of which are provided with operative notches, i.e. dies adapted to crimp the sections $B_1$ and $B_2$, and other ones defining distance means between the first named ones. This construction is known and lies outside the scope of the present invention.

According to the present invention, a locator device 20 is in a readily affixable and dismountable manner attached to one side face 13*a* of the jaw 13 which together with the associated handle 11 defines a rigid tool body 19. Because the pair of tongs 10 has two pairs of crimping dies (for the purpose explained above), the device 20 is adapted for co-operation with two pairs of dies represented by the half-pairs 15*a*, 15*b* in FIG. 3.

The following description, however, will for simplicity refer to a device co-operating with one pair of dies, because a device according to the invention adapted for co-operation with several pairs of dies simply comprises one or more "copies" of the basic device located one along the other, as seen in FIG. 3.

The locator device 20 comprises in a body 21 a track able to accomodate the longest contact portion A of a cable shoe considered for treatment in a given tool. In the example shown, the track is defined by the bottom portion 22 of a reception opening 23. The track is terminated by a stationary or fixed first stopmeans, in the embodiment shown defined by a transverse terminal wall 22A of the reception opening 23 defined by a blind hole. The stop 22A is spaced from the frontface 20A of the device 20 by the above said distance $L'_A$, i.e. the length of the longest contact portion A. In the space behind the stop 22A is located a pivot pin 24 in the body 21 for mounting a movable stop carrier 25.

The movable, and in the example shown, pivotable stop carrier 25 is defined by an elongated, planar plate which at one end is provided with an opening 25A for the pivot pin 24 and which has an extension 25B and a bent-off portion or grip 25C defining an actuating means of the stop carrier.

The planar plate 25 has on its longitudinal edge turned towards the track a projection 25D whose front edge 25D', i.e. the edge farther away from the opening 25A, is, when the planar plate 25 is mounted on the pin 24, spaced from the front face 20A of the device 20 by the above named distance $L_A$, i.e. the length of the short contact portion A. The front face 20A is intended and adapted for attachment to the side face 13A of the pair of tongs 10.

A helical spring 27 is accomodated in a bore 21A in the body 21 and is so long, as to project somewhat from the bore 21A when at rest. After the planar plate 25 has been mounted into the body 21, the spring 27 gets compressed as its projecting end bears against the edge 25B' of the extension 25B on the plate. Plate 25 is thereby constantly affected in the sense of arrow $P_1$ and the projection 25D is with its bottom edge 25D'' pressed against the bottom portion 22 of the body 21, i.e. against the track. The planar plate 25 continues beyond the projection 25D and has at the end which is turned towards the front face 20A a continuously bent or smoothly curved lower front edge 25E turned towards the track and which terminates with a section 25E' adjacent the front edge 25D' of the projection 25D.

Figure 4:
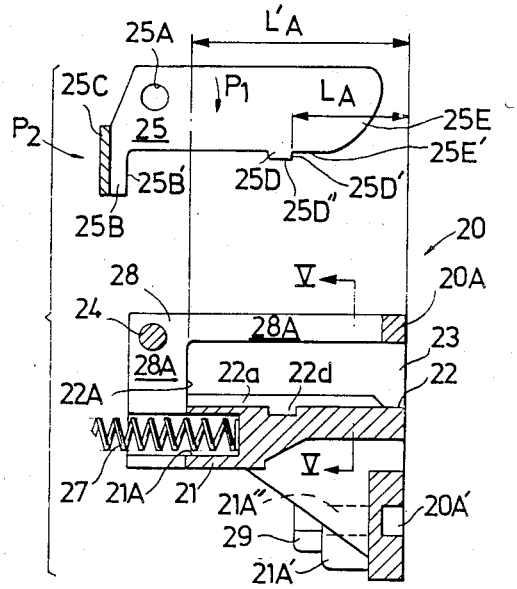

For mounting the planar plate 25 in the body 21, there is provided in this body a longitudinal slot 28 limited by planar side walls such as **28*a* and extending opposite the bottom portion 22 and in the transverse side of the body opposite the front face 20A, as it is seen in FIG. 4**.

Figure 5:
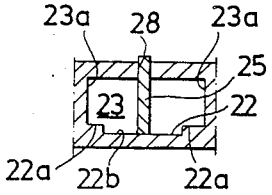

The bottom portion 22 can be preferably provided with two longitudinal, elevated lateral ramps **22*a* according to FIG. 5. The central area 22*b* between the two lateral ramps 22*a* serves for the centered accomodation of cable shoes having a narrower contact portion A, while cable shoes with a wider contact portion A may rest on the two lateral ramps 22*a* and are centered by the lateral walls 23*a* of the opening 23**.

The edge 25D' of the projection 25D is preferably so dimensioned, that when a short contact portion A is pushed into the opening 23 and beneath the smoothly curved edge 25E, the whole planar plate 25 is somewhat lifted against the force of the spring 27 before the contact part A can abut against the edge 25D'. Due to the smooth curvature of the edge 25E, this lifting is easily achieved, and when the contact portion reaches the front edge 25D' of the projection 25D, it is by the section 25E' of the edge 25E pressed down on the bottom portion 22, whereby the position of the cable shoe is stabilized. Section 25E' defines thus a pressing means for this purpose.

To the same purpose, and alternatively or complementarily to the described arrangement, a recess **22*d* may be provided in the bottom portion 22 and in which at least a part of the projection 25D can be accomodated, so that the edge section 25E', defining a pressing means, is in rest position located still closer to the bottom portion 22**.

For easy mounting and dismounting of the device 20, when adapted to be used as an optional accessory of the crimping tool, an opening 21A'' for a retainer screw 18' with a nut 29 (FIG. 2) is provided in a bulge 21A' on the body 21. The retainer screw 18' corresponds essentially to the screw 18, but is longer. In the front face 20A is at least one depression 20A' provided into which tightly fits one of the pins, not shown, which in jaw 13 correspond to the pins 16, 17 in jaw 14, and which also is made somewhat projecting from the side face **13*a*. Thereby is the position of the device 20 exactly defined in respect of the pair of tongs 10, after the nut 29** has been tightened.

The pins 16, 17 etc. may often be embodied by spring blades rolled into a tube having a small central opening. Such pins in the jaw 13 may be flush with the side face **13*a* and on the front face 20A of the device 20 are as means of engagement instead of the depression 20A' short, thin pins 20A'' (FIG. 6**) provided which fit into the central openings.

The device of FIGS. 2 to 5 is operated as follows. For attachment to a pair of cable shoe tongs, one of the screws 18 of the tongs is replaced by a somewhat longer screw 18' with a nut 29. Cable shoes such as 101 with a shorter contact portion A and having a conductor introduced in their crimping portion B are inserted into the open pair of jaws 13, 14 from the right hand side in FIG. 3 and with their contact portion A ahead, until this contact portion A strikes the front edge 25D' of the projection 25. In the process, the planar plate 25 has been somewhat pivoted about the pin 24 and the spring 27 presses it down on the inserted contact part A. Then the cable shoe is crimped on the conductor in conventional manner.

When cable shoes such as 102 with a longer contact portion A are treated, one proceeds in the same manner, but by depressing the actuating grip 25C in the sense of arrow $P_2$, the planar plate 25 is pivoted against the sense of arrow $P_1$. The front edge of the contact portion A abuts therefore against the end wall 22A. The actuating grip 25C is then released, and the bottom edge 25D'' of the projection 25D presses down the contact portion A due to the action of spring 27. Also a long contact portion A is thus stabilized, i.e. pressed against the bottom portion 22 as a short contact portion A. Thereafter, the cable shoe is crimped in conventional manner. When the crimped-on cable shoe has been removed from the tool 10, the planar plate 25 returns into its initial position by action of the spring 27.

What is claimed is:

1. A locator device for a tool with crimping dies for cable shoes which have a crimping portion and a contact portion of different lengths, wherein the device comprises a body which has first and second ends and comprises at least one elongated track for accommodating said contact portion of a cable shoe inserted into the tool, means for attaching said body to the tool, said track extending from said first end toward the second end of the body and having a bottom portion, two side walls and a stationary first stop means at said second end, said stop means terminating said track at a distance from said first end which corresponds to the longest crimping portion of a cable shoe to be treated in the tool, a stop carrier with an operating means and which is constantly affected by a spring force and is against this force movable transversely to the direction of the track; at least one movable second stop means arranged on said stop carrier between said first and second ends at a distance from said first end which corresponds to the length of a shorter contact portion of a cable shoe to be treated, and which at least one second stop means either clears or bars said track, depending on the position of the stop carrier, wherein the stop carrier is defined by an elongated planar plate extending parallel with the track and pivoted to the body at said second end thereof, and said second stop means is defined by a forward edge of a projection on said plate extending towards the bottom portion of the track.

2. The device of claim 1, wherein on the stop carrier is adjacently the second stop means provided a pressing means defined by at least a part of an edge and adapted to stabilize a contact portion of either length inserted into said track by pressing it against the bottom portion of the track.

3. The device of claim 1, wherein a recess is provided in the bottom portion of the trac for accomodating at least a part of said projection.

4. The device of claim 1, wherein from said second stop means extends towards said first end a smoothly curved lower edge whose section adjacent to said stop means defines a pressing means adapted to stabilize a contact portion of the shorter length inserted into said track by pressing it against the bottom portion of the track.

5. The device of claim 1, wherein the bottom portion of the track comprises two elongated elevated ramps for supporting contact portions with greater width, and a depressed central area between said ramps for receiving contact portions with lesser width.

6. The device of claim 1, wherein said means for attaching said body to the tool is a screw which is provided in the tool for mounting one of the crimping dies, and wherein the body at a front face thereof is provided with at least one means of engagement for exactly defining the position of the device in respect of the tool.

7. The device of claim 1, wherein a plurality of tracks and associated first and second stop means is provided in the body for co-operation with an equal plurality of die pairs in the tool.

8. The device of claim 1, wherein the stationary first stop means is settable.

* * * * *